US005446524A

United States Patent [19]

Koike

[11] Patent Number: 5,446,524

[45] Date of Patent: Aug. 29, 1995

[54] IMAGE FORMING DEVICE WITH A FUNCTION OF SELECTING RECORDING PAPER

[75] Inventor: Tadao Koike, Suginami, Japan

[73] Assignee: Ricoh Company, Ltd., Tokyo, Japan

[21] Appl. No.: 83,308

[22] Filed: Jun. 29, 1993

[30] Foreign Application Priority Data

Jun. 29, 1992 [JP] Japan ..... 4-194849

[51] Int. Cl.[6] ..... G03G 15/00

[52] U.S. Cl. ..... 355/208; 271/9.05; 271/9.06; 355/311

[58] Field of Search ..... 355/311, 319, 24, 25, 355/208, 209, 308, 309; 271/9, 265

[56] References Cited

U.S. PATENT DOCUMENTS

| | | | |
|---|---|---|---|
| 4,218,128 | 8/1980 | Satomi et al. | 355/24 X |
| 4,339,293 | 7/1982 | Takahashi et al. . | |
| 4,650,313 | 3/1987 | Koike . | |
| 4,655,582 | 4/1987 | Okuda et al. | 355/311 X |
| 4,763,889 | 8/1988 | Dei et al. | 355/311 X |
| 4,839,740 | 6/1989 | Yoshida | 355/24 X |
| 4,846,057 | 7/1989 | Endo et al. . | |
| 4,887,168 | 12/1989 | Endo et al. . | |
| 4,954,849 | 9/1990 | Koike et al. . | |
| 4,966,073 | 10/1990 | Hasegawa et al. . | |
| 4,975,749 | 12/1990 | Tsunoda et al. . | |
| 4,979,727 | 12/1990 | Koike et al. . | |
| 5,005,049 | 4/1991 | Matsushita | 355/208 |
| 5,014,091 | 5/1991 | Koike et al. . | |
| 5,053,814 | 10/1991 | Takano et al. | 355/208 |
| 5,067,835 | 11/1991 | Yamamoto et al. | 355/311 X |
| 5,086,320 | 2/1992 | Koike . | |

FOREIGN PATENT DOCUMENTS

| | | |
|---|---|---|
| 0247656 | 12/1985 | Japan . |
| 0311268 | 12/1988 | Japan . |
| 0099079 | 4/1989 | Japan . |

*Primary Examiner*—Robert B. Beatty

*Attorney, Agent, or Firm*—Oblon, Spivak, McClelland, Maier, & Neustadt

[57] ABSTRACT

In an image forming device provided with a copy mode of forming an image on the rear surface of a one-surface-copied recording paper and another copy mode of forming am image on both surfaces of the recording paper, the image forming device is provided with a function of selecting the recording paper which is capable of obtaining the desired copy only by selecting and executing the mode of copying without paying attention to the type of the recording paper accommodated in the paper feeding apparatus (whether it is both-surfaces-blank or one-surface-copied). The image forming device further has an image-existence/absence detector for detecting whether the image has been already copied on one surface of the recording paper accommodated in the paper feeding apparatus, and a controller for selecting the paper feeding tray accommodating the recording paper of the size and type fitted to the both-surfaces-copying mode in accordance with the detection signal received from the image existence/absence detector.

3 Claims, 8 Drawing Sheets

FIG. 4A(1)
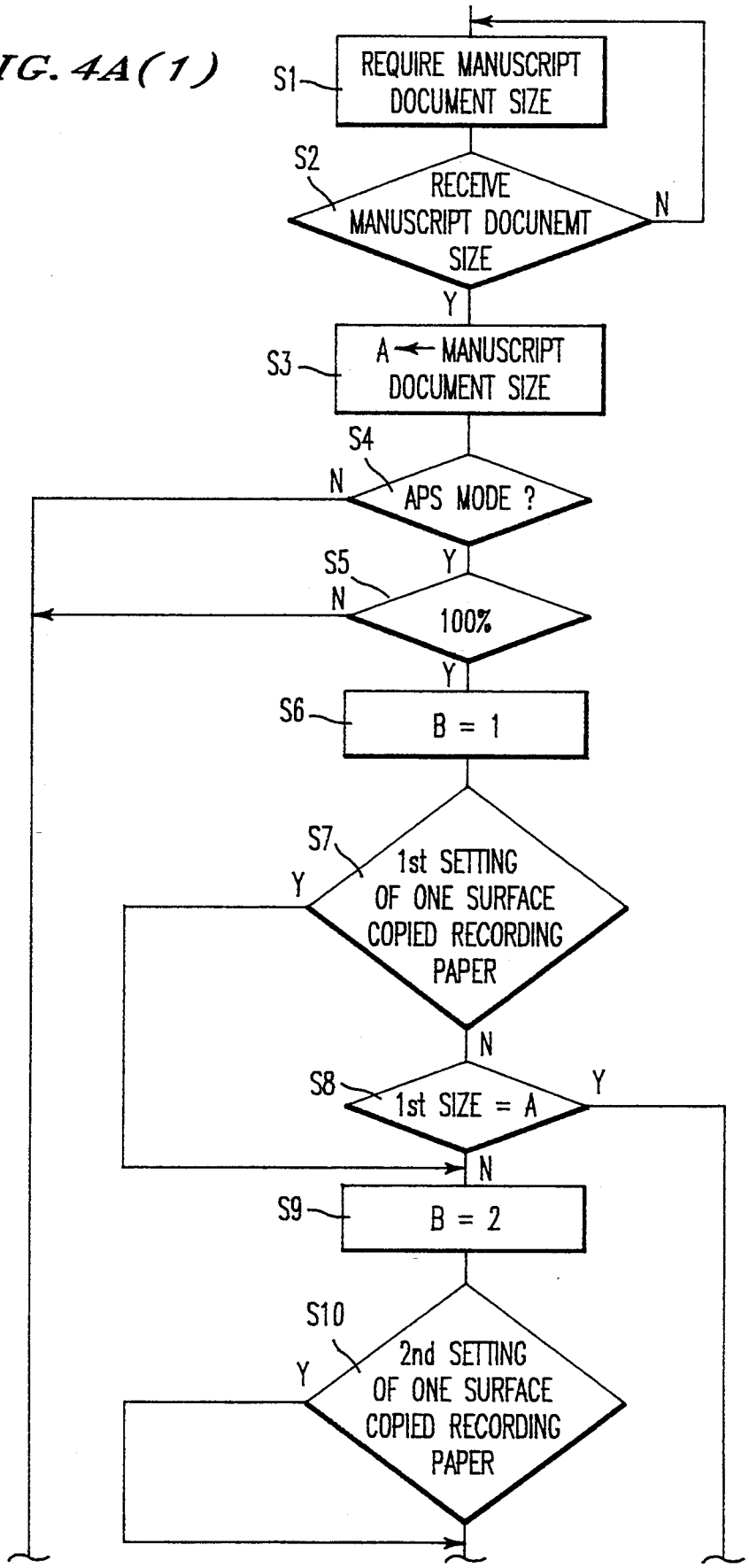

FIG. 4A(2)

| SIZE OF MANUSCRIPT DOCUMENT | CODE |
|---|---|
| A3 | 01 |
| B4 | 02 |
| A4T | 03 |
| A4Y | 04 |
| B5T | 05 |
| B5Y | 06 |
| ⋮ | ⋮ |

S1
REQUIRE MANUSCRIPT DOCUMENT SIZE
S2
RECEIVE MANUSCRIPT DOCUNEMT SIZE
N
Y
S3
A ← MANUSCRIPT DOCUMENT SIZE
S4
DUPLEX COPY MODE ?
Y
*1 FIG.4
S5
N
APS MODE ?
Y
S6
N
100%
Y
S7
B = 1
S8
1st SETTING OF ONE SURFACE COPIED RECORDING PAPER
Y
S9
B = 2
S10
2nd SETTING OF ONE SURFACE COPIED RECORDING PAPER
Y
*2
*3
*4
*5
SELECTING PART OF ONE SURFACE COPIED RECORD-ING PAPER

IMAGE FORMING DEVICE WITH A FUNCTION OF SELECTING RECORDING PAPER

BACKGROUND OF THE INVENTION

1. Field of the Invention

The present invention relates to improvement of an image forming device having a two sided copying capability in a copier, a printer, a facsimile device, etc., which is capable of forming a toner image on both surfaces of the recording paper by use of an electrophotographic method.

2. Description of the Related Art

An image forming device utilizing an electro-photographic process in conventional devices such as a copying machine, a printer, a facsimile device or the like is provided with a recording paper feeding apparatus. The recording paper fed by the paper feeding apparatus is transported into an image forming portion having a photosensitive body at the center thereof, and an image is formed on the transported paper. The recording paper supplied to the paper feeding apparatus is usually blank and does not have an image on either side thereof. However, it is sometimes necessary to write in an image by use of the above-mentioned image forming apparatus on specially-used recording paper having a predetermined format consisting of characters, lines or figures already printed thereon.

However, there exists hitherto no image forming apparatus specifically designed for using recording paper already copied on one surface thereof and accommodated in the paper feeding cassette or tray, and thereafter forming an image on the other surface which is blank.

There presently exists a conventional device capable of automatically detecting the size of the recording paper accommodated in the paper feeding apparatus. However, there exists no device capable of judging whether only one surface of the recording paper has already been printed on.

There also exists hitherto a device capable of judging whether the size of recording paper selected in a both-sides copying mode is capable of being accommodated in the paper-refeeding apparatus, stopping the operation of the mode in case that the selected size cannot be accommodated in the paper-refeeding apparatus, and giving a warning to the operator.

For instance, Japanese Laid-Open Patent publication No. 58-40564/1983 discloses a device comprising first and second sheet accommodating portions and constructed so as to detect the size of the sheet in one sheet accommodating portion when no sheet is in the other sheet accommodating portion, and to change over the sheet accommodating portion and feed the sheet of paper to the accommodating portion for which the size of the sheet is fitted.

Furthermore, Japanese Laid-Open Patent publication No. 63-87429/1988 discloses a device capable of performing a copying operation and emitting an alarm in case recording paper of a size which cannot be accommodated in the paper refeeding apparatus is selected when a copy-mode which requires accommodating the recording paper in the paper refeeding apparatus is selected.

However, in all of the above-mentioned cases, there are only performed processes of control and display in accordance with the size of the recording sheet accommodated in the paper feeding apparatus. There is neither the function of detecting and judging whether one surface of the recording paper has already been printed or both surfaces of the paper are blank, nor the function of causing the device to perform processes of control and display in accordance with the result of the above judgement.

In recent years an increasing number of users perform image formation on the rear surface of recording paper, one surface of which already has an image formed thereon, in order to realize savings of resources and expenses. Furthermore, both-sides copying has often been done for the same reason. Therefore, in case that the user selectively executes one of two modes, a mode of copying on the rear surface of recording paper which has been already copied on its one surface or another mode of both-sides copying, it was necessary to confirm each time the sort of the recording paper accommodated in the paper feeding apparatus, i.e., whether both surfaces of the paper were blank or one surface of the paper had been already copied, and to select the paper feeding cassette which accommodated recording paper in accordance with the selected mode.

SUMMARY OF THE INVENTION

The present invention was made in consideration of the above matters in an image forming apparatus provided with the two modes: a mode of the copying the rear surface of the recording paper which has been already copied on its one surface and another mode of both-sides copying. It is an object of the present invention to provide an image forming apparatus with a recording paper selecting function which is capable of obtaining desired copying only by performing mode selection and execution, and without paying any attention to whether both surfaces of the paper are blank or one surface of the paper has been already copied.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIGS. 4*a* and 4*b* are, respectively, a flow chart showing an operation of judging the size and sort of the recording paper accommodated in the paper feeding cassette, and a table showing the relationship between the detected size of the manuscript document and its code number;

DETAILED DESCRIPTION OF THE PREFERRED EMBODIMENT

The embodiments of the present invention are disclosed herein with reference to the accompanying drawings.

Figure 1A:
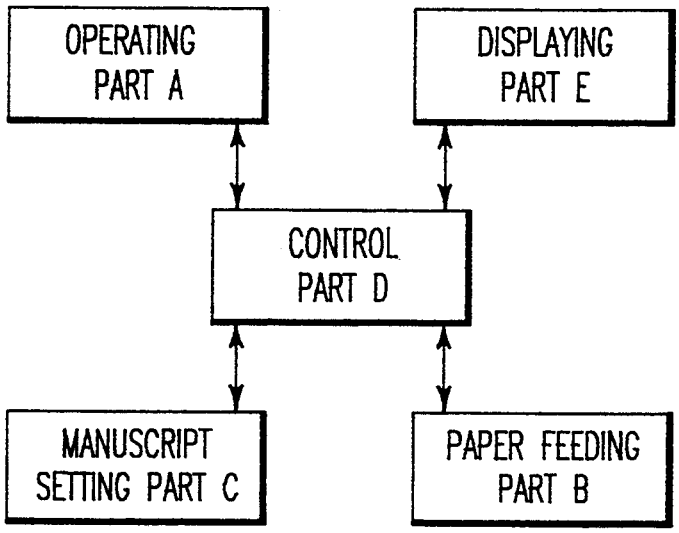
FIG. 1*a* is a block diagram of the major components of a copying machine incorporating the invention.

FIG. 1*a* is a block diagram illustrating the major components of the copying machine. It includes an operating part A which performs copying operations, a paper feeding part B and a manuscript setting part C. The above parts are controlled by a control part D having a displaying part E.

Figure 1B:
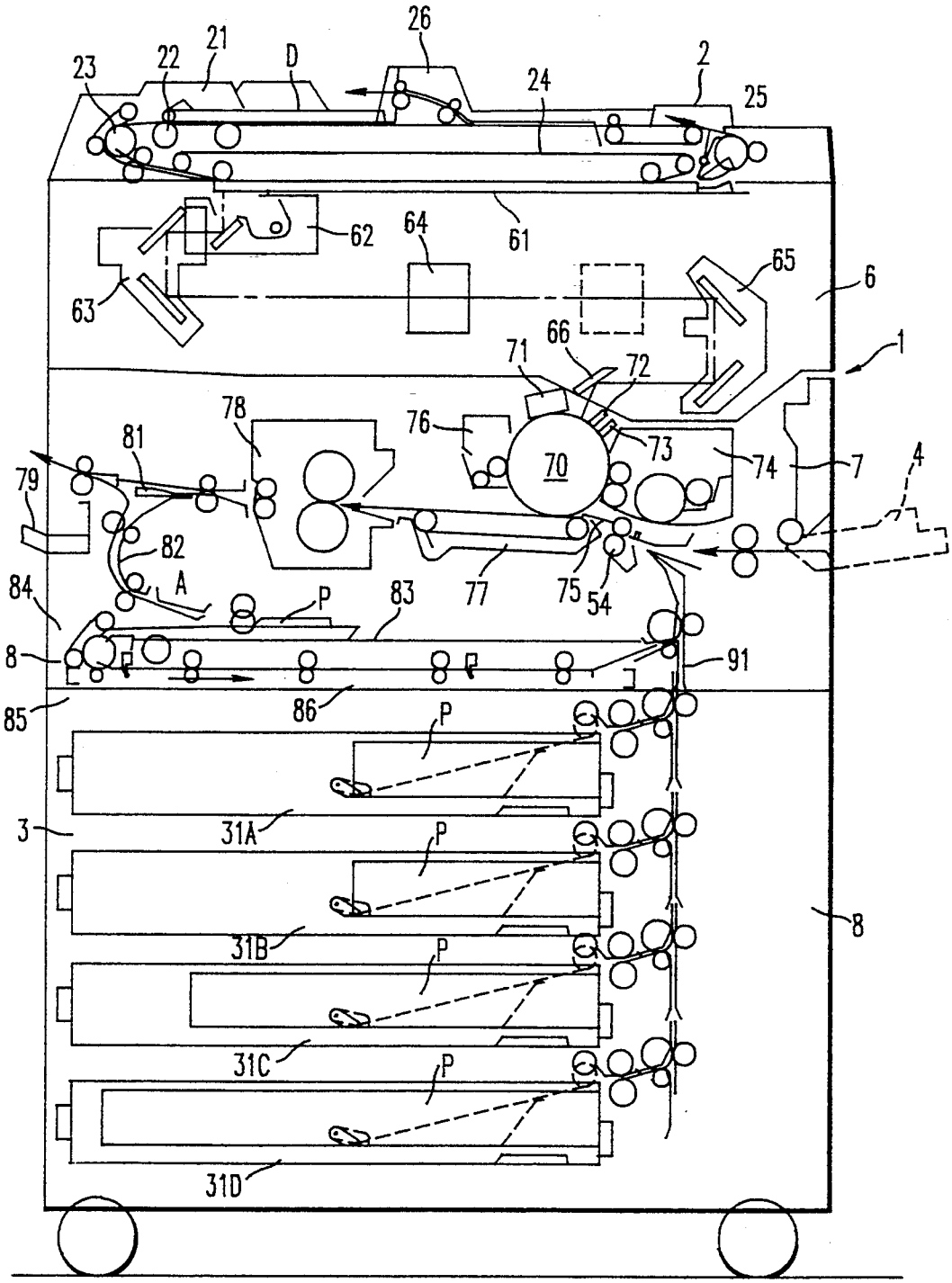
FIG. 1*b* is an overall outline view showing a copying machine with a function of selecting recording paper according to an embodiment of the present invention.

FIG. 1*b* is an overall outline view of an embodiment of the main body of the copying machine with a function of selecting recording paper according to the present invention. The copying machine consists of a main body 1 of the machine and a circulation-type document transporting apparatus (Recirculating Document Handler, briefly named RDH) 2 which is installed on the upper side of the machine's main body as the manuscript setting part C. After forming the image on the upper surface of the recording paper P fed from the paper feeding apparatus 3 via the transportation route 9 and by use of an image forming apparatus 7, the recording paper P is fed once again to the image forming apparatus 7. It is thus possible to form the image on the other surface of the recording paper which is not copied with the image.

A tray 83 for accommodating the recording paper to be copied on both surfaces thereof (called "both surfaces tray" hereinafter) which is disposed below the image forming apparatus 7 is provided with a first turning-over apparatus 82 for turning over the one-surface recording paper P sent in via a separation claw 81 and sending the recording paper P onto the both-surfaces tray so as to face downward, and a paper refeeding apparatus 84 for separating, sheet by sheet, and refeeding the recording paper P sent onto the both-surfaces tray 83, beginning with the lowermost sheet, by use of frictional force and in a direction opposite to that (arrow A) of sending the paper onto the both-surfaces tray 83.

The both-surfaces tray 83, the turning-over apparatus 82 and the paper refeeding apparatus 84, etc., form an intermediate paper feeding apparatus 8 for performing both-surface copying.

An exposing apparatus 6 having a contact glass 61 on the upper surface thereof is disposed in the machine's main body 1. The exposing apparatus 6 is constructed with a first scanning system 62 composed of a light source and a mirror 63, a lens 64, a movable mirror system 65, a fixed mirror 66 and so on. Furthermore, the image forming apparatus 7 is composed of a photosensitive drum 70, a charger 71, erase lamps 72–73, a development unit 74, discharge lamp 75, a transfer unit 77, a cleaning unit 76 and a fixing unit 78, etc., and is disposed below the exposing apparatus 6.

The paper feeding apparatus 3 is provided with paper feeding trays 31A through 31D which are vertically arranged in four stages disposed below a horizontal transporting apparatus 86, and a hand-inserting tray 4 which is disposed at the right side of the horizontal transportation apparatus 86. Fresh recording paper P is selectively fed to the image forming area on the image forming apparatus 7 from either one of those trays 31A–31D and 4.

In FIG. 1 the thick arrow marks represent the transportation routes for transporting the manuscript document D and the recording paper P. Since the structure of RDH 2 is well known, for example from U.S. Pat. No. 4,954,849, a detailed explanation thereof is omitted here. A large number of the document sheets D stacked in a manuscript document setting portion 21 are sent out in order from the lowermost sheet onto contact glass 61 of the exposing apparatus 6, as shown by the arrow, by use of a feed roller 22, a separation roller 23, and a transporting belt 24, and are sent back to the manuscript document setting portion 21 by a paper discharge roller 26 via a turning over roller 25 so as to realize the same order as the initial order.

The recording paper P, on one surface of which the image is formed by the image forming device 7, is guided by the separation claw 81 and stacked on the both-surfaces tray 83.

The process of making copied sheets by use of the copying machine according to the present invention is briefly described below:

As shown in FIG. 1, the documents D are set on the document setting portion 21 of the RDH 2 so as to place the image surface thereof facing upward, and are sent out leftward beginning with the lowermost of paper sheets. The documents are then turned to face downward, transported onto the contact glass 61, and stopped at a predetermined exposing position.

Subsequently, the image on the manuscript document is projected onto the photosensitive drum 70 of the image forming apparatus 7 by the exposing apparatus 6 (exposing process). An electrostatic latent image is thus formed on the surface of the photosensitive drum 70 which has been uniform charged by the charger 71.

After completing this exposing operation, the manuscript document is transported again, turned to face upward and sent back to the initial position of the manuscript document setting portion 21 by the paper discharging roller 26. Moreover, when changing the size of the document, it may be permissible to slide the position of the paper discharging roller 26 to the right or left direction in the drawing (FIG. 1).

The electrostatic latent image on the photosensitive drum 70 is converted to a visible image by developing the latent image with toner attached thereto by the development unit 74. The recording paper P is sent into the image forming area (on this occasion, to the area to which it is transferred by a transfer belt apparatus 77) from either one of the respective paper feeding trays 31A through 31D or from the hand-inserting tray 4 via the register rollers 54, and the visible image is transferred onto the surface of the recording paper P. The transferred image is then fixed by a fixing unit 78.

Toner remaining on the photosensitive drum 70 is cleaned by the cleaning unit 76 in preparation for the next image forming operation.

Figure 7:
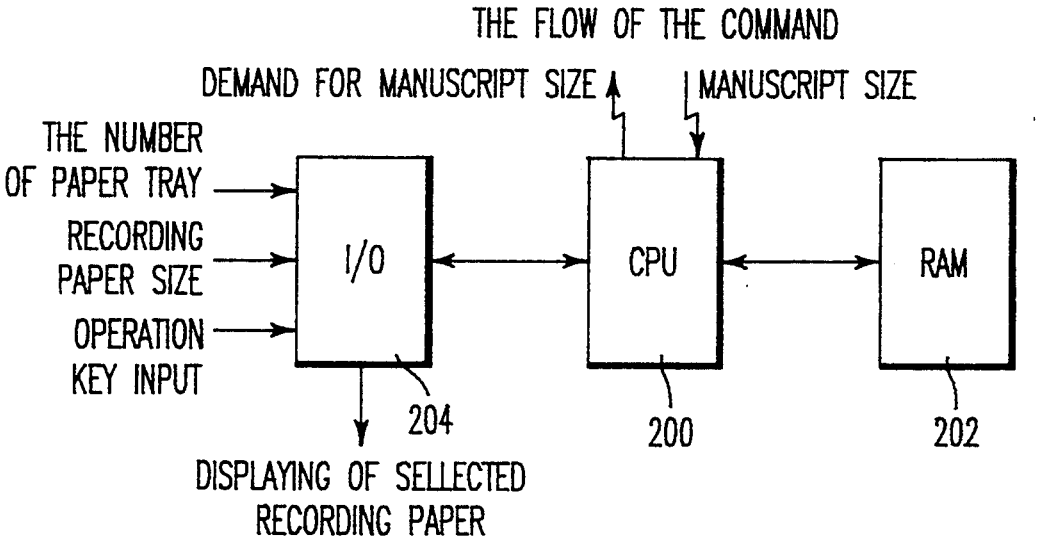
FIG. 7 is a block diagram of the control part.

The control of the above-mentioned operations is performed by the control part D including a microcomputer having a CPU 200, a RAM 202 and an I/O port 204 (FIG. 7). The I/O port receives inputs of the paper tray number, the recording paper size and the operation key input. It outputs a selected recording paper to the display part E. The CPU receives an input of the manuscript size and outputs a demand for the manuscript size.

In case the mode of performing both-surfaces-copying (both surfaces-copying mode) is selected, the recording paper P having an image fixed on its one surface is guided downward by the separation claw 81, and sent along direction A into the turning-over apparatus 82.

Figure 3:
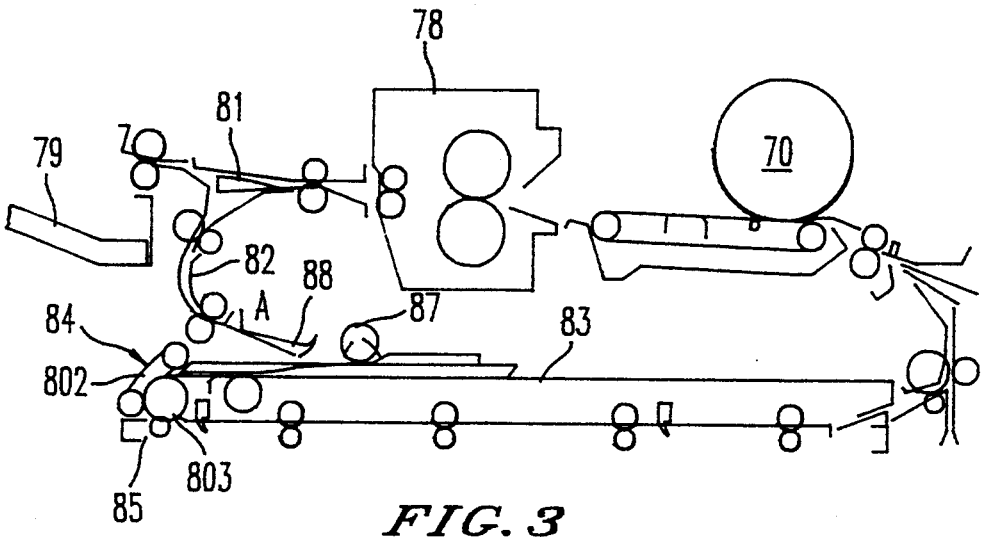
FIG. 3 is a front outline view showing the construction of an intermediate paper feeding apparatus.

The recording paper P is turned over in the apparatus 82 so as to put its image surface downward and is stacked on the both-surfaces tray 83. The one-surface-copied recording paper P stacked on the both-surfaces tray 83 is refed, sheet by sheet, in order from the lowermost stacked recording paper, by the paper refeeding apparatus 84, in the direction opposite to the direction A of sending the recording paper P onto the both-surfaces tray 83. This refeeding utilizes the frictional force due to a feeding roller 87 pressed by a pressurizing arm 88, a separation roller 803, and a separation belt 802, etc. (refer to FIG. 3.)

The recording paper P refed by the paper refeeding apparatus 84 is transported back to the image forming apparatus 7 through the second turning-over apparatus 85 constructed with the separation roller 803, the separation belt 802 and a guide plate, etc., thereby turning over the surface of the recording paper P so as to put the image surface upward again (to put the blank surface downward). In this manner the paper is transferred via path 91, with the blank surface of the recording paper P facing upward, into the image forming apparatus 7 where an image is formed on the back side thereof.

The recording paper P having images on both surfaces thereof is guided to the separation claw 81, directed straight to the left in FIG. 1*b*, and discharged onto a paper discharging tray 79.

Figure 2:
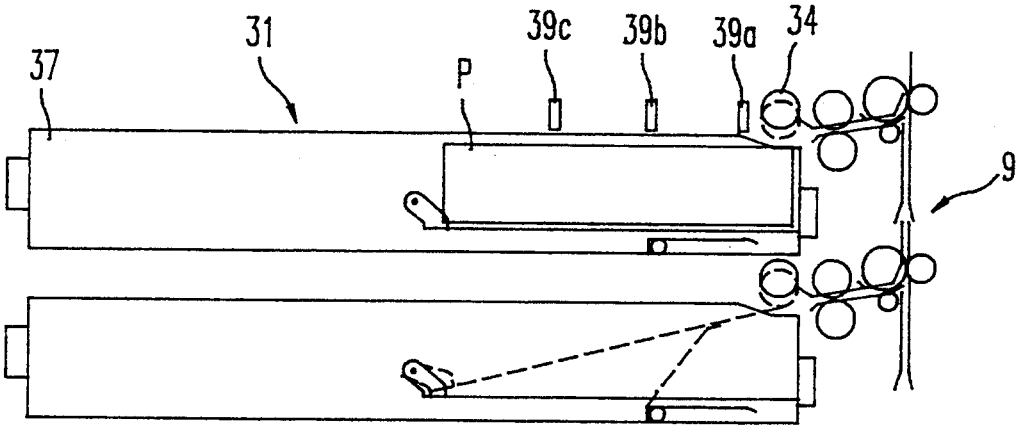
FIG. 2 is a front outline view showing a paper feeding apparatus having plural sensors for detecting the presence/absence of the image recorded on the upper surface of the recording paper.

Next, FIG. 2 is a front elevational outline side view showing the construction of the recording paper feeding apparatus 3 having a plurality of sensors for detecting the presence or absence of the recorded image on the upper surface of the recording paper. The automatic recognition of whether one surface of the recording paper P accommodated in the paper feeding apparatus 31 is blank is described hereinafter in accordance with FIG. 2.

In this embodiment, a plurality of image existence/absence detectors 39A, 39B, 39C using a reflection-type optical sensor such as that shown in U.S. Pat. No. 4,865,309 are arranged above the paper feeding tray 37. The surface of the recording paper P set on the paper feeding tray 37 on which the image is to be transferred is the lower side surface in FIG. 2. An existing image may therefore be formed on the upwardly facing surface of the recording paper P set on the paper feeding tray 37. Consequently, if the image-existing/absence detectors 39A–39C detect whether an image exists on the upper-surface of the recording paper in the tray, it is possible to judge whether the recording paper P set in the paper feeding tray 37 has an image copied on one surface thereof.

Namely, when an image exists on any portion of the recording paper P's upper surface, one of the detectors signals varies. Therefore, it can be known that one-surface-copied paper P is set by the variation of the detection signal. The reason why a plurality of detectors are arranged in the above-mentioned embodiment is that the image on the recording paper sometimes deviates from the normal position and so even an image at a deviated position can be properly detected.

Moreover, as to the method of detecting the image existence/absence of the image, it may also be permissible to scan the upper surface of the set recording paper P by use of one movably mounted detector, without employing plural fixed detectors. Further, the paper feeding apparatus 31 is constructed with paper feeding means consisting of the paper feeding trays 31A through 31D for accommodating the recording paper and a paper feeding roller 34, etc. for taking out the accommodated recording paper and feeing it to the image forming device 7.

Next will be described the case in which, as a concrete example, one-surface-copied A4Y-size recording paper P is accommodated in the paper feeding tray 31A and both -surfaces-blank A4Y-size recording paper is accommodated in the other paper feeding tray 31B just below the tray 31A. Hereupon, in order to simplify the explanation thereof, the case of equal size and both -surfaces-copying mode is described.

Figure 4B:
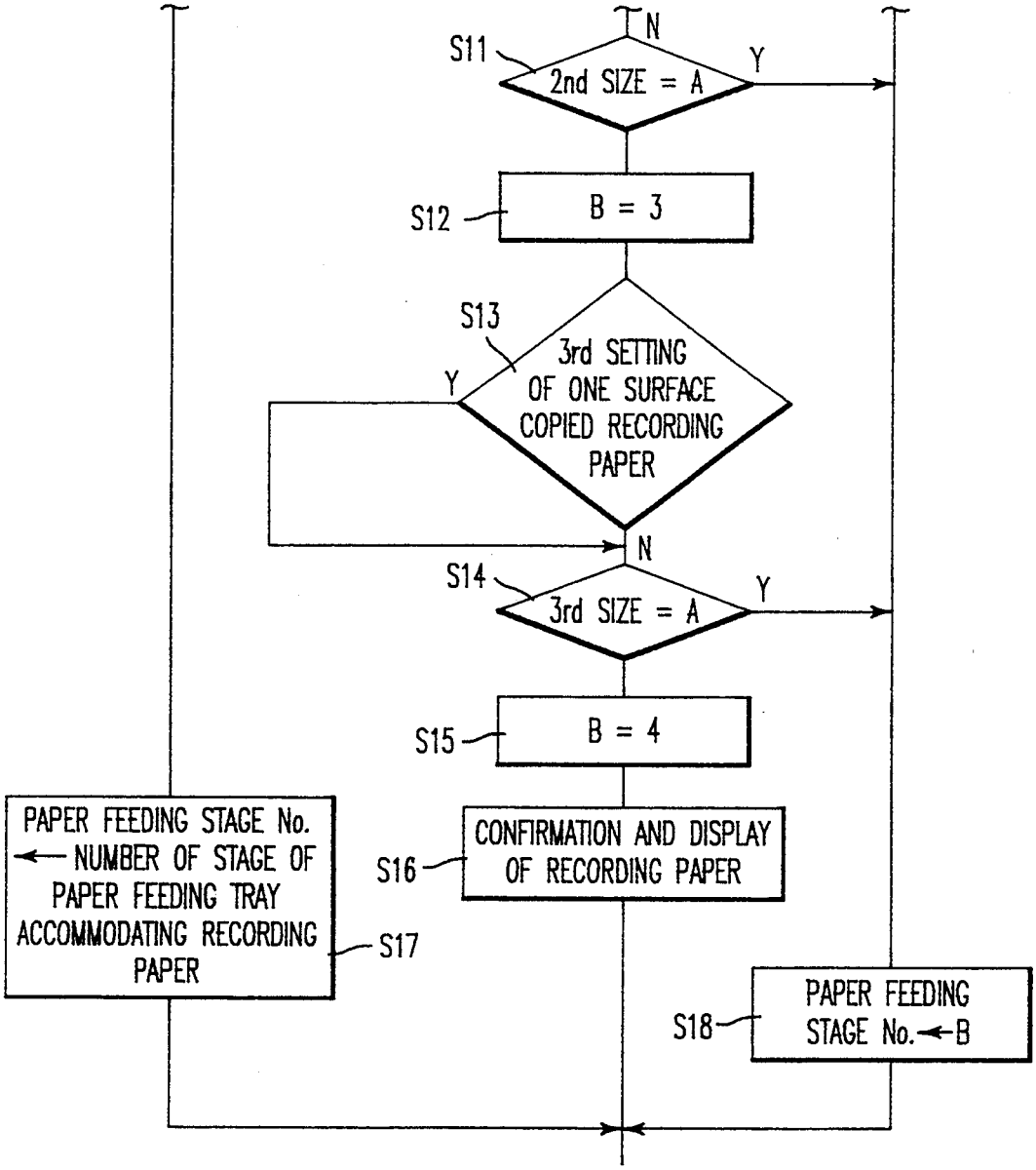

FIGS. 4*a* and 4*b* are, respectively, a flow-chart illustrating the operation of discriminating the size and type of the recording paper accommodated in the paper feeding cassette, and a table showing the corresponding relationship between the detected manuscript document size and its code number.

First, a signal requiring the size of the manuscript document is output from the (not-shown) control portion. A size signal is then output by a document size detection sensor (not shown).

On this occasion, as size A4Y is lateral A4 size, a code "04" is transmitted and stored in the control portion as data A (steps 1 to 3).

The mode at this time is APS (Automatic Paper Selection) mode (step 4), automatically recognizing the size and type of the recording paper P, wherein the "type" of paper means "both surfaces blank", "one-surface-copied", etc. In the case of 100% equal-size copying mode (step 5), the operation proceeds to step 6 and "1" is inputted as data B (stage number of the paper feeding tray)(steps 4 and 6).

Next, whether the recording paper accommodated in the first-stage recording paper feeding tray 31A is one-surface-copied recording paper is judged in step 7 by use of the sensors 39*a*–39*c*.

On this occasion, since the first-stage recording paper P (the recording paper accommodated in the first-stage tray 31A) has been copied on its one surface, the judgement result is "Yes", and the operation proceeds to the judgement of the recording paper in the next paper feeding tray, without verifying the size of the paper, since the paper in tray 31A is not compatible with both sides copying.

In step 9, "2" is inputted as data B.

In step 10, the type of recording paper P accommodated in the second paper feeding tray 31B is detected. On this occasion, since the recording paper is blank, the judgement result becomes "No", and thereafter the operation proceeds to the judgement of the paper size in step 11.

Since the size of the recording paper accommodated in the second-stage paper feeding tray is A4Y, the code for its size is "04". The code coincides with "04" stored in the memory as the data A in relation to the size of the manuscript document. Consequently, the operation proceeds to step 18 without proceeding to the checking of the paper feeding tray 31C in step 12 and steps subsequent thereto, and the value of B=2 as the identity of the paper feeding stage is outputted to the control portion for feeding paper from tray 31B.

The selection of the second-stage paper feeding tray 31B is displayed on the operation board and the operation of paper feeding is carried out at the same time.

In case all of the accommodated recording papers P are one-surface-copied or the size of the recording paper differs from that of the manuscript document, the mode of both-surfaces -copying is stopped and the display of confirmation of recording paper is done, thereby notifying the user (step 16).

If another paper feeding apparatus, for instance another feeding similar to apparatus 3 for feeding a large number of recording papers is connected to the main body of the image forming apparatus, the confirmation of the presence or absence of the one-surface copied recording paper setting and the verification of the paper size are respectively performed at step 15 in connection with the recording paper accommodated in the other paper feeding apparatus.

Figure 5:
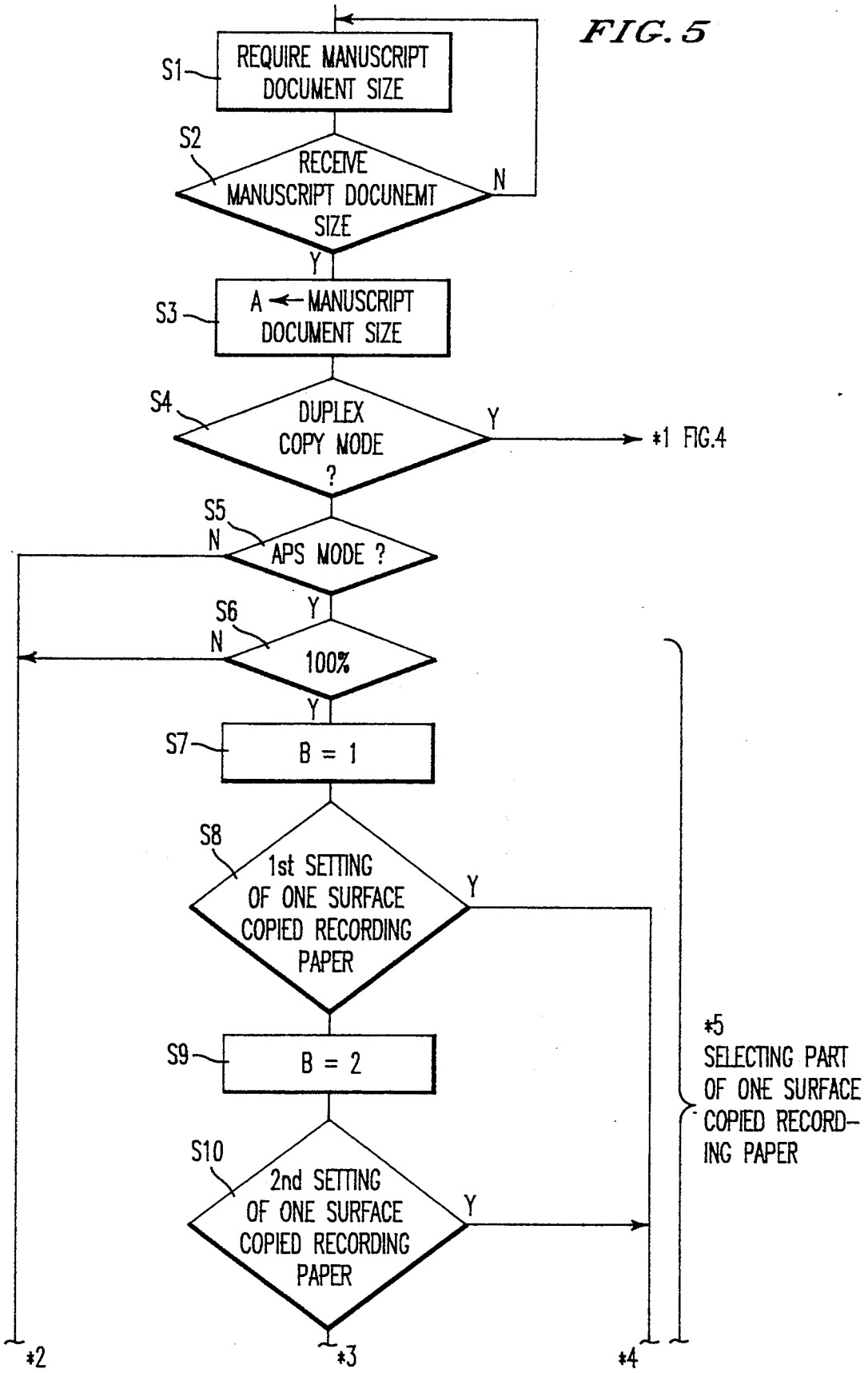
FIGS. 5 and 6 together comprise a flow chart of an operational sequence with one side copied priority.
Figure 6:
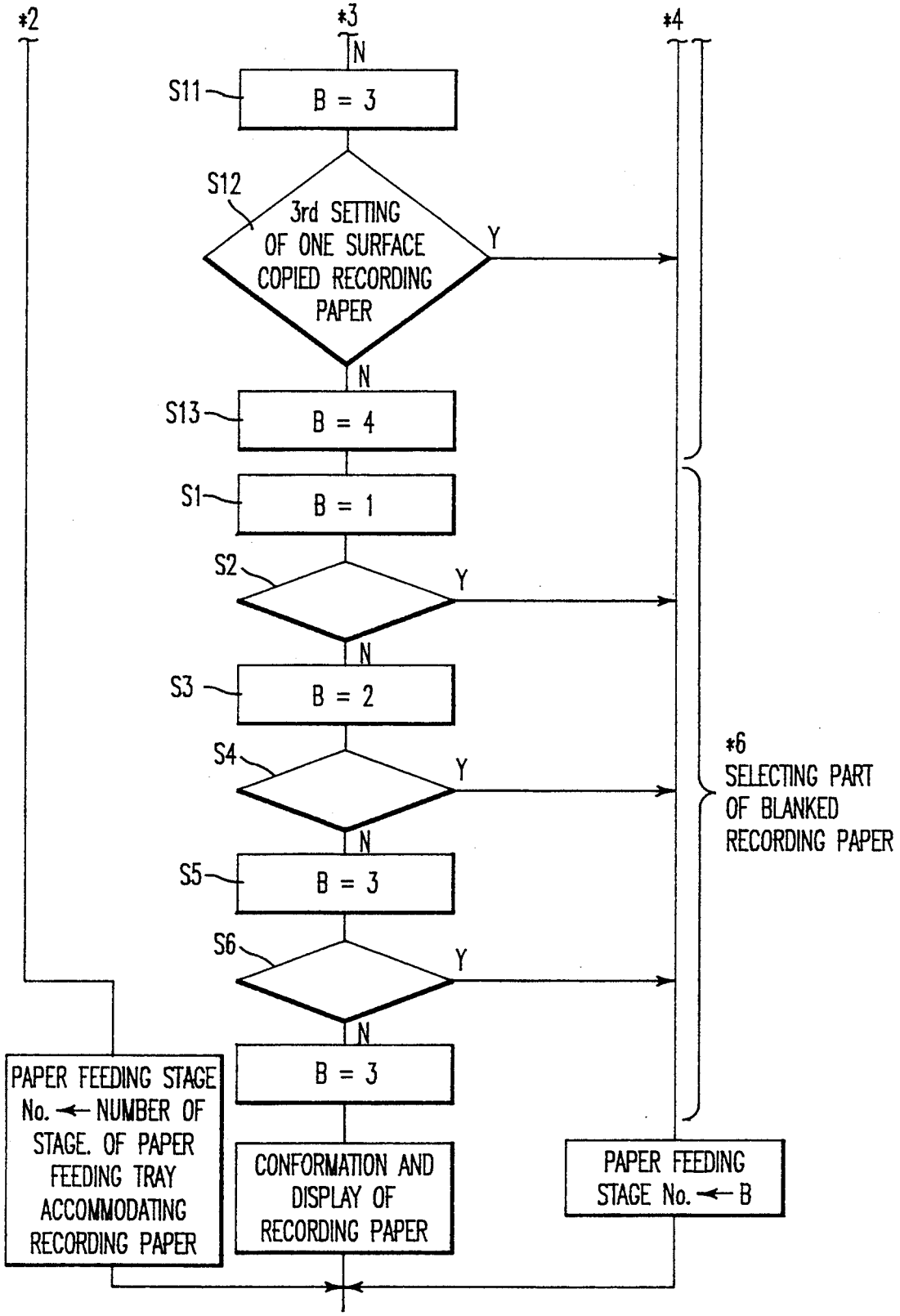

Furthermore, in the above-mentioned embodiment, in case both surfaces-blank recording paper is accommodated in a paper feeding tray and the one-surface-copied recording paper is accommodated in another paper feeding tray, the one-surface-copied recording paper is selected with priority at the time of performing one-surface-copying mode in a manner as explained below with reference to FIGS. 5 and 6 in which FIG. 6 is an extension of the flow chart of FIG. 5.

In FIG. 5, the size of the manuscript is requested in step 1. In response, the code "07" is inputted into the address A in the memory connected to the CPU in step 3, because the size of the manuscript in this case is A-4.

In step 4, judgement is made on whether the selected mode is the both-surfaces-copying mode or the one-surface-copying mode, and the result of the judgement is "No" in this case since the one-surface-copying mode is selected by the operator beforehand.

In step 5, judgement is made on whether or not the mode is APS (Auto Paper Selection), and the result of the judgement is "Yes" since the operator has selected the APS mode in this case beforehand.

In step 6, judgement is made on whether or not the mode is equal size copying, and the result of the judgement is "Yes" since the operator has selected equal size copying mode beforehand.

In step 7, the number 1 representing the first recording paper feeding cassette 31A disposed at the highest part of the feeding device 3 (see FIG. 1*b*) in which the recording paper sheets of a certain size are accommodated, is set into the address B located at a certain part of the address of the RAM 202 (Random Access Memory) connected to the CPU 200 (Central Processing Unit).

After that, judgement is made in step 58 on whether or not the code for the recording paper accommodated in the first cassette is [A+1], which represents the A-4 size and the one-surface-copied recording paper. In this case, the code "07" is set in the address A, therefore [A+1] corresponds to the code "08" and the result of the judgement is "No" because A-4 size and the both-surfaces-blank paper is accommodated in the first cassette 31A in this case, and so the code for the paper indicates "07" (it does not indicate 08).

Next, in step 9, the number in the address B is counted up by the controller to the number 2, which represents the judgement for the second recording paper cassette 31B (see FIG. 1).

In the step 10, the judgement is made on whether or not the code for the recording paper accommodated in the second recording paper cassette 31B is the code [A+1], and the result is "Yes" because, the A-4 size and the one-surface-copied recording recording paper is accommodated in the second recording paper cassette 31B, so that the recording paper cassette produces the code "08". At the same time, the number 2 in the address B is sent to the main controller of the copier (see FIG. 6) as a data representing that the recording paper in the second cassette 31B is suitable for the operation of the copier in this mode.

Therefore, the recording paper in the second cassette 31B is fed when the command of paper feeding is outputted by the main controller.

And further, in a similar case, it is permissible that when the one-surface-copied recording paper selected with priority is used up, the operation of paper feeding is performed uninterruptedly by other trays accommodating the one-surface-copies recording paper of same size.

Furthermore, when the one-surface-copied recording paper does not exist in any of the other trays, the operation of paper feeding is performed by the trays accommodating both-surfaces-blank recording paper of the same size in a manner as explained below with reference to FIG. 6. If one-surface-copied recording paper does not exist in any of the other trays, the judgement on whether or not the code of the recording paper in the first cassette 31A is "07" is executed in the step 2 in the FIG. 6 instead of the code "08" in the step 8 of the FIG. 5, so that the both-surfaces-blank recording paper of same size can be selected on this occasion.

Therefore, if the both-surfaces-blank recording paper of A-4 size is accommodated in the first cassette 31A, the result of the judgement in the step 2 in FIG. 6 is "Yes" and the paper in the cassette 31A is fed when the paper feeding command is outputted from the controller.

According to the aforementioned control of the recording paper feeding illustrated both in FIGS. 5 and 6, the one-surface copied paper is selected with a priority in the mode of one-surface-copying, and if the paper is used up, then the same size and both-surfaces-blank paper is selected as a backing-up to avoid stopping of the operation. If there is no suitable paper in the first paper cassette 31A, the other cassettes 31B–D are checked until suitable paper is discovered (see FIG. 6, step 1 to 6).

Finally, if the same-size and both-surfaces-blank recording paper is not identified in all of the judgements illustrated in the FIG. 6, the display notifies the operator that there is no suitable recording paper in any of the recording paper cassette in the mode which the operator selected so as to replenish the suitable cassette with the suitable paper.

Figure 8B:
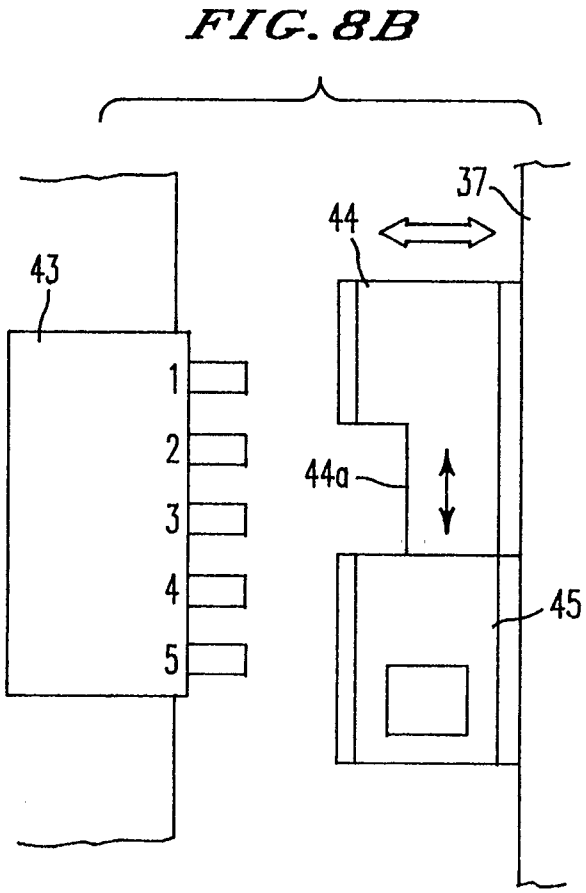
FIGS. 8*a* and 8*b* are side views showing an embodiment of notification means simultaneously notifying the size and sort of the recording paper accommodated in the paper feeding tray.
Figure 8A:
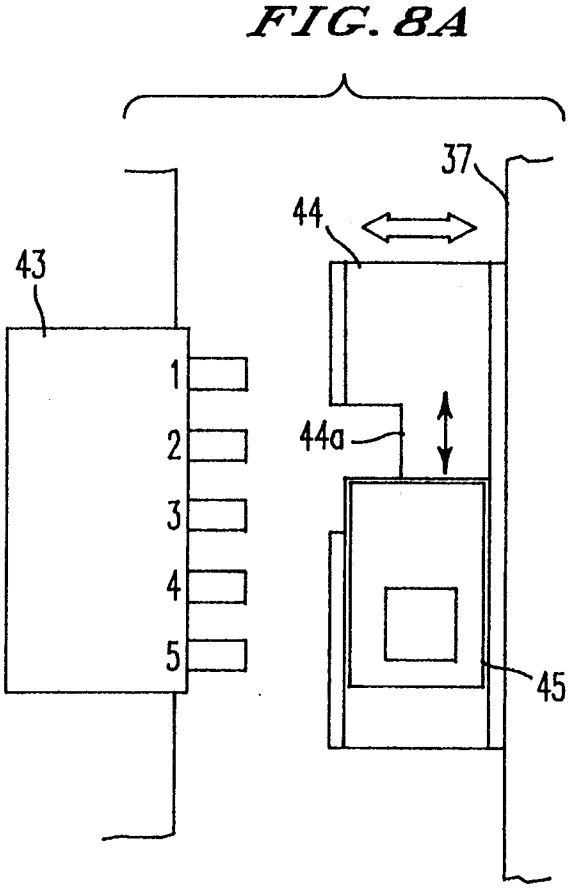

The sensor for detecting whether or not the recording paper accommodated in the upper part of the paper feeding tray is one-surface-copied paper is disposed as in the above-mentioned embodiment. However, FIGS. 8*a* and 8*b* show another embodiment capable of determining whether the paper is one-surface-copied by the action the user at the time of setting the recording paper in the paper feeding tray. Namely, in this embodiment a photosensor 43 having five sets of actuators 1–5 is disposed at the side of the image forming apparatus, for example the copier body, and is connected to the control portion of the apparatus. A shutter plate 44, having a concave portion 44*a* for switching on actuators 1–5 is installed at the side of the paper feeding tray 37 which is detachably mounted to the image forming apparatus. A movable partition member 45, which can be moved by hand in a direction shown by an arrow, is put along the shutter plate 44. The photosensor 43, the shutter plate 44 and the movable partition member 45 are positioned so as to cooperate with the photosensor 43 when the tray 37 is installed in the image forming apparatus and comprise notification means.

For instance, in the state as shown in FIG. 8*a*, since the concave portion 44*a* formed at the side surface of the shutter plate 44 is partially closed by the movable partition member 45, only the second actuator is not turned on when the paper feeding tray 37 is installed. For this reason, the control portion of the image forming apparatus receives "ON" signals from the first, third, fourth, and fifth actuators, and it is thereby possible for the control portion to be informed of the type and size of the recording paper, i.e., that the recording paper set in the paper feeding tray 27 is of the A4Y size and both surfaces of the recording paper are blank.

Conversely, in the case of setting one-surface-copied recording paper of the A4Y size in the paper feeding tray 37, the concave portion 44*a* is manually widely opened, for instance by moving the movable small partition member 45 as shown in FIG. 8*b*. Then, when the paper feeding tray 37 is installed, the actuators 2 and 3 are not turned on. As a result, the control portion receives the "ON" signals only from the first, fourth and fifth actuators and the control portion is notified that the recording paper set in the paper feeding tray 37 is of the A4Y size and one surface of the recording paper has been already copied.

In such manner, according to the embodiment shown in FIGS. 8*a* and 8*b*, a notification to the control portion of the size of the recording paper and/or another notification of whether one surface of the recording paper has been already copied can be performed by manually operating the movable member 45 installed in the paper feeding tray 37.

It is an advantage of this embodiment that the cost is reduced as compared with the automatic detection of the presence or absence of image recording in the first embodiment.

Furthermore, the notification means for notifying the control portion of the size of the recording paper and notifying it whether one surface of the recording paper has been already copied as shown in FIGS. 8*a* and 8*b* is constructed such that the size of the paper and presence/absence of the image recording thereon can be judged by the combination of "ON" and "OFF" of a plurality of switches or the like. However, this is only an example. It may be possible to employ other various modifications.

As is apparent from the foregoing description, according to the present invention, whether or not an image has been already copied on one surface of the recording paper accommodated in the paper feeding tray of the recording paper feeding apparatus is automatically detected and such detection fed to the control portion which makes judgements in accordance with the detection signal.

In case that it is possible to perform both-surfaces copying, the control portion enables the device to do both-surfaces-copying, whereas in case that it is impossible to perform the same, it is prohibited. In both cases, the control portion displays the possibility of both-surfaces-copying. Consequently, the user can continue copying without concern for whether or not one surface of the recording paper accommodated in the tray has been already copied in the both-surfaces copying mode.

Therefore, the user can easily operate the device and there is no error of both-surfaces-copying on the one-surface-copied recording paper.

Furthermore, it is instead possible to notify the control portion of the image forming apparatus whether or not the recording paper has been already copied on, and the size of the recording paper at the time of tray-setting, by manually operating the notification means installed in the paper feeding tray when the recording paper is set in the tray. The cost of the device can then be reduced in comparison with detecting the presence/absence of the image on the recording paper by use of the sensor.

Furthermore, when the both-surfaces-copying mode is selected, in case that both-surfaces-blank recording paper has not been accommodated in any paper feeding tray, the device does not execute the both-surfaces-copying mode. Therefore, it may be possible to prevent troublesome double-copying on the one-surface-copied recording paper. And further, since the device displays that it is not capable of both-surfaces-copying at that time, and the reason therefor, the user can immediately take corrective actions.

And further, since the device is capable of always displaying, on its displaying board, whether or not one surface of the recording paper accommodated in the paper feeding tray has been already copied on, even by the notification means installed in the paper feeding tray and manually set as mentioned above, the notification means can be set by referring to the above-mentioned display of the device. Therefore, the user can use the device without any erroneous operation.

Furthermore, in case of copying an unimportant document, for instance, a formal report document, etc., since it may be possible to use one-surface-copied recording paper, costs can be saved. Furthermore, assuming that the one-surface-copied recording paper and the both -surface blank recording paper are set, respectively, as first and second selection order, even where there exists a large number of paper feeding trays accommodating recording papers of same size, copying can be economically performed.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An image forming device having a plurality of recording paper trays, an image-existence/absence detecting means for detecting whether an image has already been recorded on one surface of a recording paper accommodated in said recording paper tray, and a controller including means for selecting one of the recording paper trays such that where both-surfaces-blank recording paper and one-surface-copied recording paper are accommodated, respectively, in different ones of the paper feeding trays, said controller selects said one-surface-copied recording paper in response to said detecting means and in preference to said both-surfaces-blank recording paper.

2. The image forming device having a controller as defined in claim 1, wherein said means for selecting comprises means such that where both-surfaces-blank recording paper and one-surface-copied recording paper are accommodated, respectively, in different paper feeding trays, said controller selects and feeds said one-surface-copied recording paper, and when said one-surface-copied recording paper is used up said controller uninterruptedly feeds one-surface-copied recording paper from another one of said trays.

3. The image forming device having a controller defined in claim 2 wherein said controller further comprises means such that, when one-surface-copied recording paper does not exist-in any other paper feeding tray, both-surfaces-blank recording paper is fed.

* * * * *